US008754367B2

(12) United States Patent
Kou

(10) Patent No.: US 8,754,367 B2
(45) Date of Patent: Jun. 17, 2014

(54) ORTHOGONAL ACCELERATION TIME-OF-FLIGHT SPECTROMETER HAVING STEADY POTENTIAL AND VARIABLE POTENTIAL TRANSPORT REGIONS

(75) Inventor: Junkei Kou, Toyko (JP)

(73) Assignee: JEOL Ltd., Tokyo (JP)

( * ) Notice: Subject to any disclaimer, the term of this patent is extended or adjusted under 35 U.S.C. 154(b) by 226 days.

(21) Appl. No.: 12/984,674

(22) Filed: Jan. 5, 2011

(65) Prior Publication Data

US 2011/0174967 A1 Jul. 21, 2011

(30) Foreign Application Priority Data

Jan. 15, 2010 (JP) ..... 2010-006947

(51) Int. Cl.
*H01J 49/40* (2006.01)
*H01J 49/42* (2006.01)
*H01J 49/00* (2006.01)

(52) U.S. Cl.
CPC ..... *H01J 49/401* (2013.01); *H01J 49/427* (2013.01); *H01J 49/0031* (2013.01)
USPC ..... 250/287; 250/281

(58) Field of Classification Search
CPC ..... H01J 49/40; H01J 49/062; H01J 49/4245; H01J 49/401; H01J 49/42; H01J 49/426; H01J 49/429
USPC ..... 250/287, 292
See application file for complete search history.

(56) References Cited

U.S. PATENT DOCUMENTS

| | | | | |
|---|---|---|---|---|
| 3,582,648 | A * | 6/1971 | Anderson et al. | 250/287 |
| 5,665,967 | A * | 9/1997 | Coxon et al. | 250/287 |
| 5,689,111 | A | 11/1997 | Dresch et al. | |
| 6,504,148 | B1 * | 1/2003 | Hager | 250/282 |
| 6,507,019 | B2 | 1/2003 | Chernushevich et al. | |
| 6,794,642 | B2 * | 9/2004 | Bateman et al. | 250/281 |
| 7,095,015 | B2 * | 8/2006 | Bateman et al. | 250/288 |
| 7,119,331 | B2 * | 10/2006 | Chang et al. | 250/292 |
| 7,579,585 | B2 * | 8/2009 | Hager | 250/282 |
| 7,663,100 | B2 * | 2/2010 | Vestal | 250/287 |
| 7,692,142 | B2 * | 4/2010 | Schwartz et al. | 250/290 |
| 7,728,288 | B2 * | 6/2010 | Makarov et al. | 250/282 |
| 2004/0079873 | A1 * | 4/2004 | Bateman et al. | 250/281 |
| 2005/0247872 | A1 * | 11/2005 | Loboda et al. | 250/288 |
| 2008/0087810 | A1 * | 4/2008 | Gabeler | 250/282 |
| 2008/0156980 | A1 * | 7/2008 | Rather et al. | 250/287 |
| 2008/0272291 | A1 * | 11/2008 | Vestal | 250/287 |
| 2009/0189071 | A1 * | 7/2009 | Chernushevich et al. | 250/282 |
| 2011/0155901 | A1 * | 6/2011 | Vestal | 250/282 |

FOREIGN PATENT DOCUMENTS

| | | | |
|---|---|---|---|
| JP | 2003346706 | A | 12/2003 |
| JP | 2005183022 | A | 7/2005 |

* cited by examiner

*Primary Examiner* — Brooke Purinton
(74) *Attorney, Agent, or Firm* — The Webb Law Firm

(57) ABSTRACT

A time-of-flight mass spectrometer has an ion transport region and a time-of-flight (TOF) mass analyzer. The ion transport region includes a collision cell (ion storage region), a steady potential region, and a variable potential region such that the difference in potential between the steady potential region and the variable potential region when ions passed through the steady potential region enter the steady potential region increases with increasing mass-to-charge ratio of ions. The mass analyzer causes the ions transported via the transport region to be accelerated along another optical axis at a given acceleration timing and guides the ions toward a detector.

8 Claims, 7 Drawing Sheets

ORTHOGONAL ACCELERATION TIME-OF-FLIGHT SPECTROMETER HAVING STEADY POTENTIAL AND VARIABLE POTENTIAL TRANSPORT REGIONS

BACKGROUND OF THE INVENTION

1. Field of the Invention

The present invention relates to a time-of-flight mass spectrometer.

2. Description of Related Art

It is important to accurately measure the masses of ions created by an atmospheric-pressure ionization (API) technique such as electrospray ionization (ESI) or atmospheric-pressure chemical ionization (APCI) in identifying proteins and metabolic substances. Mass spectrometry relying on a time-of-flight mass spectrometer (TOFMS) can realize both high measurement accuracy and high throughput and so this spectrometry is a promising candidate for the used technique in such applications. Where a TOFMS is interfaced to an atmospheric-pressure ion source that generates ions by such an ionization method, the difference in degree of vacuum between them is as high as about 10 orders of magnitude. Therefore, a differential pumping chamber is mounted as an interface. In the atmospheric-pressure ion source, ionization occurs continuously and, therefore, a continuous ion stream flows into the differential pumping chamber and enters into the TOFMS. In the TOFMS, the continuous ion stream is accelerated in a pulsed manner, and mass analysis is performed by utilizing differences in flight time between ions with different mass-to-charge ratios, the differences being created when they travel to a detector. The ion stream velocities have a smaller distribution width in the orthogonal direction than in the direction of travel. Consequently, to achieve higher resolution, it is now customary to adopt an orthogonal acceleration time-of-flight mass spectrometer (oa-TOFMS) in which ions are accelerated in a direction orthogonal to the ion stream.

If a quadrupole mass filter and a collision cell are mounted in the differential pumping chamber of a TOFMS, a quadrupole-quadrupole time-of-flight mass spectrometer (QqTOFMS) (i.e., a hybrid quadrupole time-of-flight mass spectrometer) is built. In this instrument, precursor ions selected by the quadrupole mass filter are fragmented in the collision cell. A mass spectrum of the resulting product ions is observed in the time-of-flight mass analyzer. The structure of the precursor ions can be estimated from the spectrum.

However, the oa-TOFMS and QqTOFMS have the problem that their efficiency of utilization of ions is low. That is, only a part of the ion stream continuously entering the orthogonal acceleration region of the TOF mass analyzer is accelerated and so ion streams not accelerated cannot be detected by the detector. This results in ion loss.

In Chernushevich et al. U.S. Pat. No. 6,507,019, in order to reduce ion loss in the QqTOFMS, a method of installing an ion trap ahead of the orthogonal acceleration region is proposed. In this instrument, the collision cell is also used as the ion trap. Ions once trapped in the collision cell are expelled as pulses. When the ions expelled in a pulsed manner reach the orthogonal acceleration region, they are accelerated in the orthogonal direction. If the efficiency at which ions are expelled in a pulsed manner out of the ion trap (collision cell) is high, the efficiency of utilization of ions in the orthogonal acceleration region should be high. In this method, however, mass dispersion takes place while ions expelled out of the ion trap (collision cell) are going to the orthogonal acceleration region. The ions are dispersed both temporally and spatially. Lighter ions reach the orthogonal acceleration region earlier and vice versa. Therefore, only ions having masses lying within a narrow range of mass-to-charge ratios are accelerated orthogonally. If the efficiency of discharge out of the ion trap is high, the ions having mass-to-charge ratios lying in this narrow range provide improved detection intensity. The problem is that the other ions cannot be detected.

In Dresch et al. U.S. Pat. No. 5,689,111, a method of increasing the efficiency of utilization of ions by connecting an ion trap to an oa-TOFMS is proposed but this method suffers from a problem similar to the problem with the method of the Chernushevich et al. patent.

In JP-A-2005-183022, a method is proposed which realizes higher sensitivity of a quadrupole-quadrupole time-of-flight mass spectrometer (QqTOFMS) including a first trap made of the collision cell and a second trap disposed between the first trap and the orthogonal acceleration region while maintaining a wide range of mass-to-charge ratios. In this instrument, ions are sequentially mass-selected in the first trap and discharged into the second trap, where they are once trapped and expelled in a pulsed manner. If the trap period in the second trap is made shorter than the expelling time from the first trap, ions expelled from the second trap by a single expelling operation are narrowed in mass range. Because ion pulses having a narrower mass range are less affected by mass dispersion, the ions can be admitted into the detector efficiently by the orthogonal acceleration region. In this method, however, mass selection is done in the first trap and, therefore, the orthogonal acceleration must be done plural times in order to measure ions of all mass-to-charge ratios. Hence, this instrument is lower in throughput than the normal quadrupole-quadrupole time-of-flight mass spectrometer (QqTOFMS) capable of orthogonally accelerating ions of all mass-to-charge ions at a time.

In JP-A-2003-346706, a method is proposed which realizes high sensitivity over a wide range of mass-to-charge ratios when a three-dimensional (3D) quadrupole ion trap and an orthogonal acceleration time-of-flight mass spectrometer (oa-TOFMS) are connected. In this instrument, heavier ions can be expelled from the ion trap earlier by creating a potential difference between the two end caps of the 3D quadrupole ion trap and successively increasing the amplitude of the RF voltage on the ring electrode. On the other hand, lighter ions travel at higher speeds in the region extending from the ion trap to the orthogonal acceleration region and, therefore, ions can be admitted into the orthogonal acceleration region simultaneously without recourse to mass-to-charge ratio. In this method, ions must be focused at one point inside the ion trap for each mass-to-charge ratio before the ions are expelled out of the ion trap. This is based on the premise that a pseudopotential given by Eq. (5) JP-A-2003-346706 is formed but it is formed only within a range to which adiabatic approximation can be applied. This range of application is restricted by the value of q-parameter given in Eq. (2) of this patent document. However, this restriction is not taken into consideration in this patent document and so the range of mass-to-charge ratios of ions is, in practice, narrower than represented by Eq. (16) of this patent document. Furthermore, even if the pseudopotential is faulted, ions can be converged at one point inside the ion trap for each mass-to-charge ratio only in the case of a 3D quadrupole ion trap having a small trap capacity. The convergence is impossible with a 2D ion trap having a larger trap capacity.

SUMMARY OF THE INVENTION

In view of the foregoing problems, the present invention has been developed. According to some aspects of the present invention, a time-of-flight mass spectrometer can be offered which is capable of achieving higher sensitivity and higher throughput for ions having a wide range of mass-to-charge ratios.

The present invention provides a time-of-flight mass spectrometer for performing mass analysis based on differences in flight time between ions which are different in mass-to-charge ratio, the spectrometer having ion transport stage for causing ions created by an ion source to be transported in a first direction and a time-of-flight mass analyzer for causing the ions transported via the ion transport stage to be accelerated in a second direction at a given acceleration timing and guiding the ions into a detector. The ion transport stage includes ion storage stage for storing at least parts of the ions created by the ion source and expelling the stored ions in the first direction, a steady potential region formed behind the ion storage stage as viewed along the first direction and providing a constant potential when the ions expelled from the ion storage stage pass through the steady potential region, and a variable potential region formed behind the steady potential region as viewed along the first direction and providing a potential that varies with time when the ions passed through the steady potential region enter the variable potential region. The potential in the variable potential region is varied in such a way that the potential difference between the variable potential region and the steady potential region increases with increasing mass-to-charge ratio of ions on entering the variable potential region.

In this time-of-flight mass spectrometer, the potential is constant across the steady potential region and so ions having larger mass-to-charge ratios travel at lower speeds and vice versa. On the other hand, the potential in the variable potential region is so varied that the potential difference between the steady potential region and the variable potential region becomes greater as ions having larger mass-to-charge ratios enter the variable potential region. Therefore, in the variable potential region, ions with greater mass-to-charge ratios travel at higher speeds and vice versa.

Therefore, in the time-of-flight (TOF) mass spectrometer according to the present invention, ions can have a smaller distribution width temporally and spatially at the acceleration timing (acceleration starting point) in the second direction than in the prior art TOF mass spectrometer not having such a variable potential region. Therefore, ions having masses lying in a wider range of mass-to-charge ratios can be detected with a single acceleration. In consequence, a TOF mass spectrometer, according to the present invention, makes it possible to achieve higher sensitivity and higher throughput for ions having masses lying in a wider range of mass-to-charge ratios.

In a TOF mass spectrometer as disclosed herein, the potential in the variable potential region may be so varied that ions accelerated in the second direction at least at or near a given extraction position in the time-of-flight mass analyzer can reach the detector and that ions having mass-to-charge ratios in a range to be observed arrive at or near the extraction position at the acceleration timing.

In a TOF mass spectrometer as disclosed herein, ions having mass-to-charge ratios in the range to be observed can be made to arrive at or near the extraction position at the acceleration timing (acceleration starting point) in the second direction by varying the potential in the variable potential region. Accordingly, ions having mass-to-charge ratios in the range to be observed can be detected with a single acceleration.

In a TOF mass spectrometer as disclosed herein, the potential in the variable potential region may be so varied that ions having smaller mass-to-charge ratios among the ions having mass-to-charge ratios in a range to be observed exit from the variable potential region earlier. The potential in the space through which the ions leaving the variable potential region travel until they are accelerated in the second direction may be varied to equal the potential in the variable potential region at least until ions having a minimum mass-to-charge ratio in the observed range arrive at the acceleration timing after leaving the variable potential region.

In this configuration, the ion velocities do not vary after exiting from the variable potential region. Ions having mass-to-charge ratios travel at higher speeds and vice versa. Therefore, the temporal and spatial distribution width of ions at the acceleration timing (acceleration starting point) in the second direction can be further reduced. Consequently, this TOF mass spectrometer makes it possible to detect more ions with a single acceleration.

In a TOF mass spectrometer disclosed herein, the TOF mass analyzer may include a deflector for temporally varying the strength of the electric field in the first direction according to mass-to-charge ratio of ions such that the kinetic energies of passed ions based on their movements in the first direction are made constant.

Generally, accelerated ions cannot reach the detector unless their kinetic energies based on their motions in the first direction lie within a given range. However, in this TOF mass spectrometer, the kinetic energies of the ions which have passed through the deflector and are based on their motions in the first direction are made constant. Therefore, even ions having kinetic energies which are based on their motions in the first direction and which do not lie in the given range during acceleration pass through the deflector and thus can reach the detector. Consequently, this TOF mass spectrometer can reduce ion loss.

In a TOF mass spectrometer as disclosed herein, the axial voltage V(t) in the variable potential region when ions pass through it may be given by $$V(t)=V1(V1-V3)\times(L2/L1)^2\times\{t/(tf1-t)\}^2$$

where V1 is the axial voltage in the ion storage region, V3 is the potential in the steady potential region when ions pass through it, L1 is the length of the steady potential region taken in the first direction, L2 is the distance between the entrance of the variable potential region and the extraction position, t is the time elapsed since ions were expelled from the ion storage region, and tf1 is the time for ions having mass-to-charge ratios lying in a range to be observed to arrive at or near the extraction position since they were expelled from the ion storage region.

In this geometry, ions having the mass-to-charge ratios in the range to be observed are present at or near the extraction position at the timing (acceleration starting point) at which they are accelerated in the second direction and, therefore, more ions can be detected. In addition, the size of the detector can be reduced further.

In a TOF mass spectrometer as disclosed herein, the potential in the variable potential region is so varied that ions having the mass-to-charge ratios lying in the range to be observed arrive at or near the given position in the variable potential region and that ions having larger mass-to-charge ratios exit from the variable potential region earlier. The potential in the space through which ions travel until accelerated in the second direction after leaving from the variable potential region may be kept constant at least until the acceleration timing since the ions having a maximum mass-to-charge ratio out of the range to be observed were discharged from the variable potential range.

In this TOF mass spectrometer, ions of greater m/z travel at lower speeds in the steady potential region and vice versa. On the other hand, in the variable potential region, ions of greater m/z travel at higher speeds and vice versa. Ions of greater m/z exit from the variable potential region earlier. Since the potential is constant until ions are accelerated in the second direction after leaving the variable potential region, ions of greater m/z travel again at lower speeds and vice versa. Accordingly, this instrument makes it possible to narrow the temporal and spatial distribution width of ions at the timing (acceleration starting point) at which ions are accelerated in the second direction. Consequently, more ions can be detected with a single acceleration.

In a TOF mass spectrometer as disclosed herein, the potential in the variable potential region may be varied according to the mass-to-charge ratios of the ions as they exit from the variable potential region so as to keep constant kinetic energies of the ions which have mass-to-charge ratios within the range to be observed and which are based on their motions in the first direction at the acceleration timing.

In this TOF mass spectrometer, with respect to the ions having m/z in the range to be observed, the kinetic energies based on their motions in the first direction at the acceleration timing (acceleration starting point) at which they are accelerated in the second direction are kept constant and so all ions with m/z lying in the range to be observed can be made to reach the detector. Accordingly, this instrument can reduce ion loss even if there is no deflector.

In a TOF mass spectrometer as disclosed herein, the axial voltage V(t) in the variable potential region when ions enter it may be given by $$V(t)=V1-(V1-V3)\times(L5/L1)^2\times\{t/(tf2-t)\}^2$$

where V1 is the axial voltage in the ion storage region, V3 is the potential in the steady potential region when ions pass through it, L1 is the length of the steady potential region taken in the first direction, t is the time elapsed since ions were expelled from the ion storage region, tf2 is the time for ions having mass-to-charge ratios in a range to be observed to arrive at the given position in the variable potential region since they were expelled from the ion storage region, and L5 is the distance from the entrance of the variable potential region to the given position in the variable potential region. The axial voltage V(t) in the variable potential region when the ions exit from the variable potential region can be $$V(t)=V5+V11-(V1-V3)\times\{(L3\times tf2-L5\times t)/(L1\times t-L1\times tf2)\}^2$$

where V11 is the potential in the space through which the ions travel until they are accelerated in the second direction since departure from the variable potential region, V5 is a transmission characteristic voltage intrinsic to the TOF mass analyzer, and L3 is the length of the variable potential region taken in the first direction.

In this geometry, the kinetic energies of ions with m/z in the range to be observed at the timing (acceleration starting point) at which they are accelerated in the second direction can be kept constant, the kinetic energies being based on their motions in the first direction.

In a TOF mass spectrometer as disclosed herein, the ion transport means may include an ion selection portion for selecting precursor ions having mass-to-charge ratios lying in a desired range from the ions created in the ion source and passing them. The ion storage region may create product ions by fragmenting at least some of the precursor ions passed through the ion selection portion.

In this TOF mass spectrometer, the range of mass-to-charge ratios of ions that can be detected is wide. Product ions of various mass-to-charge ratios can be detected at a time. Consequently, the structure of the precursor ions can be estimated efficiently.

Other objects and features of the invention will appear in the course of the description thereof, which follows.

DESCRIPTION OF THE PREFERRED EMBODIMENTS

The preferred embodiments of the present invention are hereinafter described in detail with reference to the drawings. It is to be noted that the embodiments described hereinafter are not intended to unduly restrict the contents of the present invention as set forth in the appended claims. Furthermore, all elements of the configurations described hereinafter are not always the essential constituent components of the invention.

1. First Embodiment (1) Structure

Figure 1:
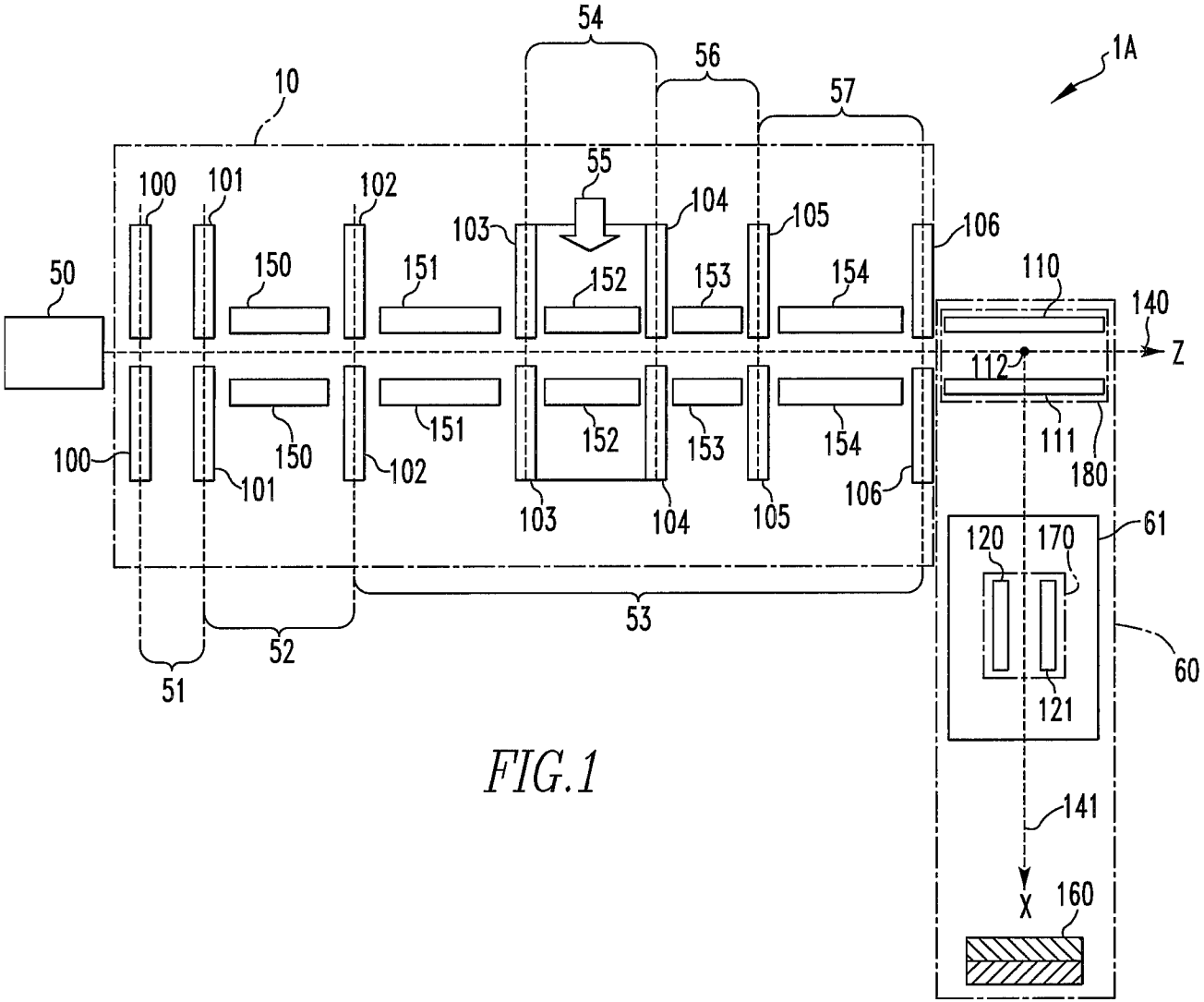
FIG. 1 is a schematic vertical cross section of a time-of-flight (TOF) mass spectrometer according to a first embodiment of the present invention, showing the structure of the spectrometer.

The structure of a time-of-flight (TOF) mass spectrometer according to a first embodiment of the present invention is first described. FIG. 1, which is a schematic vertical cross section of the TOF mass spectrometer, shows the structure of the spectrometer of the first embodiment.

Referring to FIG. 1, a time-of-flight (TOF) mass spectrometer according to the first embodiment of the invention is generally indicated by reference numeral 1A and configured including an ion transport region 10 and a TOF mass analyzer 60. The spectrometer 1A may also be configured including an ion source 50.

The ion source 50 ionizes samples by a given method. For example, the ion source 50 can be realized as an atmospheric-pressure continuous ion source that continuously creates ions by an atmospheric-pressure ionization (API) method such as ESI.

The ion transport region 10 includes a skimmer electrode 100 and another electrode 101 located behind the ion source 50. The space between the skimmer electrode 100 and the electrode 101 forms a first differential pumping chamber 51.

A multipole ion guide 150 is mounted behind the electrode 101. A further electrode 102 is mounted behind the ion guide 150. The space between the electrodes 101 and 102 forms a second differential pumping chamber 52.

A quadrupole mass filter 151 and a collision cell 54 are mounted behind the second differential pumping chamber 52. The collision cell 54 has an inlet electrode 103 and an exit electrode 104 which are positioned at the opposite ends of another multipole ion guide 152. The collision cell 54 is equipped with gas inlet means 55 (such as a nozzle) for admitting a gas from the outside. A further multipole ion guide 153 is mounted behind the exit electrode 104 of the collision cell 54. A further electrode 105 is mounted behind the ion guide 153, which may be omitted. Additional multipole ion guide 154 is mounted behind the electrode 105. A still other electrode 106 is mounted behind the ion guide 154. The space between the electrodes 102 and 106 forms a third differential pumping chamber 53.

The ion transport region 10 constructed as described so far transports the ions created by the ion source 50 to the TOF mass analyzer 60.

In the TOF mass analyzer 60, an orthogonal acceleration region 180 including a pushout electrode 110 and an extraction electrode 111 is formed behind the electrode 106 of the ion transport region 10.

The ions created by the ion source 50 travel along an optical axis 140 (z-axis) from the skimmer electrode 100 to the extraction position 112 in the orthogonal acceleration region 180. On arriving at or near the given extraction position 112 in the space between the pushout electrode 110 and extraction electrode 111 of the orthogonal acceleration region 180, the ions are accelerated along an optical axis 141 (x-axis) orthogonal to the optical axis 140 (z-axis). The direction of the optical axis 140 (z-axis) is one example of the "first direction" of the present invention, while the direction of the optical axis 141 (x-axis) is the "second direction" of the invention.

The ions accelerated in the orthogonal acceleration region 180 are guided to a detector 160 along the optical axis 141 (x-axis) by a deflector 170 formed by electrodes 120 and 121 mounted parallel to the optical axis 141 (x-axis). An equipotential region 61 which is uniform in potential is formed around the deflector 170.

Given independent or interrelated voltages are applied to the electrodes 100, 101, 102, 103, 104, 105, 106, 110, 111, 120, 121, multipole ion guides 150, 152, 153, and 154, and quadrupole mass filter 151 from a voltage supply (not shown) so that at least some of the ions generated by the ion source 50 reach the detector 160.

As described so far, the time-of-flight mass spectrometer 1A is built as a quadrupole-quadrupole TOF mass spectrometer (QqTOFMS) incorporating the quadrupole mass filter 151 and collision cell 54.

(2) Operation

The operation of the TOF mass spectrometer 1A is next described. In the following description, it is assumed that the ions created by the ion source 50 are positive ions. The same theory can also be applied to an instrument in which the ions generated are negative ions if the voltage polarity is reversed.

The ions generated by the ion source 50 pass through the skimmer electrode 100 and electrode 101 and enter the multipole ion guide 150. The pressure in the first differential pumping chamber 51 between the skimmer electrode 100 and the electrode 101 is normally on the order of 100 Pa. The pressure inside the second differential pumping chamber 52 is on the order of $10^{-2}$ Pa and considerably lower than the pressure inside the first differential pumping chamber 51, i.e., has a higher degree of vacuum. A large amount of air is admitted into the multipole ion guide 150 through the orifices in the electrode 101. Inside the ion guide 150, the kinetic energies of the ions are reduced to about room temperature because of collision between the ions and the air molecules. For this reason, the total energy of the ions present on the downstream side of the second differential pumping chamber 52 is approximately equal to the product of the axial voltage V0 in the multipole ion guide 150 and the amount of charge of the ions.

The ions having the reduced kinetic energies enter the quadrupole mass filter 151 (one example of the ion selection portion of the present invention), where desired ions are selected as precursor ions which are in turn admitted into the collision cell 54. The pressure inside the third differential pumping chamber 53 where the mass filter 151 and collision cell 54 are mounted is on the order of $10^{-4}$ Pa and thus the ion stream can be regarded as a molecular stream. Therefore, when an inert gas such as nitrogen or argon is admitted into the collision cell 54, the collisional energy between the precursor ions and the admitted gas is, at maximum, approximately equal to the product of the potential difference between the axial potentials in the multipole ion guides 150 and 152 and the amount of charge of the ions. If the collisional energy is equal to or higher than a certain value, the precursor ions are fragmented, resulting in product ions. The efficiency at which the product ions are generated can be adjusted by the potential difference between the axial voltages in the multipole ion guides 150 and 152.

In the present embodiment, the collision cell 54 acts also as an ion storage region (the ion storage region of the present invention). That is, storing and expelling of ions in the collision cell 54 is repeated by applying a pulsed voltage to the exit electrode 104. In particular, let V1 be the axial voltage in the multipole ion guide 152. A voltage V2 higher than the axial voltage V1 is impressed on the exit electrode 104 during storing, and a voltage V3 lower than the axial voltage V1 is applied during expelling.

In order to admit the precursor ions selected by the quadrupole mass filter 151 into the collision cell 54 at all times, a voltage that is lower than the axial voltage V0 and higher than the axial voltage V1 is invariably applied to the inlet electrode 103. The ions returning to the inlet electrode 103 after being bounced off the exit electrode 104 are reduced in energy because of the collisional cooling with the introduced gas. Consequently, almost no reverse flow of ions from the inlet electrode 103 takes place. The transmission factor of the collision cell 54 can be maintained almost at 100%.

The precursor ions continuously admitted in the collision cell 54 are expelled in a pulsed manner from the exit electrode 104 by repeating the expelling operation and the storing operation in this way. The pulsed ions contain unfragmented precursor ions and various product ions produced by fragmentation. The time duration is approximately equal to the time Ta for which the exit electrode 104 is opened. The total energy of the expelled ions is roughly equal to the product of the axial voltage V1 in the multipole ion guide 152 and the amount of charge of the ions because of the collisional cooling with the gas.

The space between the exit electrode 104 and the electrode 105 acts as the steady potential region of the present invention. That is, a steady voltage equal to or less than the axial voltage V1 is applied to the electrode 105. Where the multipole ion guide 153 is installed here, its axial voltage is set to a steady voltage that is equal to or less than the axial voltage V1. More specifically, a steady potential region 56 kept at a constant potential is formed on the optical axis (x-axis) between the exit electrode 104 and the electrode 105. In the steady potential region 56, lighter ions travel at higher speeds. For the sake of simplicity of discussion, it is assumed hereinafter that the axial voltage in the electrode 105 and multipole ion guide 153 is set equal to the voltage V3 on the exit electrode 104 during expelling unless otherwise specifically stated. In this case, the time t1 in which ions with m/z pass through the steady potential region 56 is given by $$t1(m/z) = L1\sqrt{\frac{m}{z}}\sqrt{\frac{1}{2e(V1-V3)}} \quad (1)$$

where L1 is the distance from the exit electrode 104 to the electrode 105, m is the mass of an ion, z is the valence number of the ion, and e is the elementary charge.

Furthermore, in the present embodiment, the ions passed through the steady potential region 56 are guided to the orthogonal acceleration region 180 by making both the axial voltage in the multipole ion guide 154 and the voltage applied to the electrode 106 a variable voltage V4(*t*) that varies with time. That is, a variable potential region 57 whose potential varies with time is formed on the optical axis (z-axis) between the electrodes 105 and 106.

Further, in the present embodiment, after ions having masses lying in a predetermined mass range pass through the electrode 106 and before accelerated orthogonally, the voltage applied to the pushout electrode 110 and the voltage applied to the extraction electrode 111 are made equal to the axial voltage V4(*t*). When the ions are accelerated in the orthogonal direction, the voltage on the pushout electrode 110 is temporarily made higher than the voltage on the extraction electrode 111. Consequently, the ions are pushed out almost orthogonally from the extraction position 112 or from around it towards the detector 160. Although the axial voltage V4(*t*) varies temporally, no axial electric field is produced at each instant of time. Therefore, the velocity component v1 of the ions in the z-axis direction in the variable potential region 57 remains the same as the component assumed immediately after entering the multipole ion guide 154. That is, the following relationship holds:

$$v1(m/z) = \sqrt{\frac{z}{m}}\sqrt{2e(V1-V4(t))} \quad (2)$$

It is to be noted, however, that in order to satisfy Eq. (2), it is necessary to reduce the effects of the fringing fields of the multipole ion guide 154 by making the length of the multipole ion guide 154 sufficiently larger than the diameter of its incircle.

In the present embodiment, the axial voltage V4(*t*) is so set that lighter ions travel at lower speeds in the variable potential region 57, contrary to in the steady potential region 56. That is, the axial voltage V4(*t*) increases when lighter ions enter the multipole ion guide 154 and vice versa.

The time t2 taken for ions with m/z to reach the extraction position 112 from the electrode 105 is given by $$t2(m/z) = L2\sqrt{\frac{m}{z}}\sqrt{\frac{1}{2e(V1-V4(t))}} \quad (3)$$

where L2 is the distance from the electrode 105 to the extraction position 112.

In the present embodiment, the mass dispersion occurring in the steady potential region 56, i.e., lighter ions travel at higher speeds, can be canceled out by the variable potential region 57. In consequence, high sensitivity can be obtained over a wide range of masses. Where ions having mass-to-charge ratios from ma/z to mb/z are observed (ma/z<mb/z), the mass dispersion in the steady potential region 56 can be canceled out by making the ions with ma/z and ions with mb/z arrive at the extraction position 112 at the same time.

Figure 2:
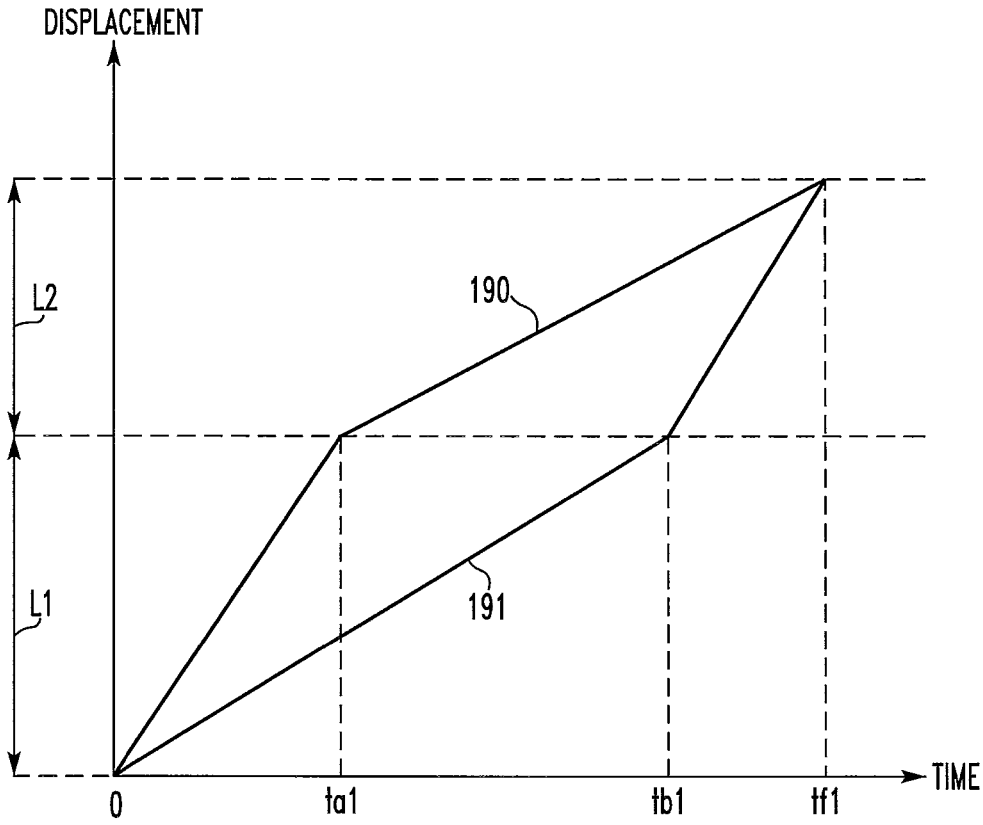
FIG. 2 is a graph of examples of displacements of ions in the first embodiment.

FIG. 2 is a diagram showing examples of displacements occurring during a period between the instant when two ions having mass-to-charge ratios of ma/z and mb/z, respectively, are expelled from the collision cell 54 and the instant when they arrive at the extraction position 112. In FIG. 2, the vertical axis indicates the displacement (distance) from the exit (exit electrode 104) of the collision cell 54. The horizontal axis indicates the time since the ions were expelled from the collision cell 54. The displacement of the ion with ma/z is indicated by 190. The displacement of the ion with mb/z is indicated by 191.

In the steady potential region 56, the ion with ma/z travels faster than the ion with mb/z. Accordingly, as shown in FIG. 2, the ion with ma/z passes through the electrode 105 at instant ta1 and then the ion with mb/z passes through the electrode 105 at instant tb1. That is, the ions with ma/z and mb/z arrive at the position of the distance L1 at the instants ta1 and tb1, respectively.

In the variable potential region 57 and orthogonal acceleration region 180, the ion with mb/z moves faster than the ion with ma/z in a reverse manner. The ion with mb/z and the ion with ma/z arrive simultaneously at the extraction position 112 at instant tf1. That is, the ion with ma/z and ion with mb/z simultaneously arrive at the position of the distance (L1+L2) at the instant tf1.

As can be seen from FIG. 2, those ions which pass through the steady potential region 56 at instant t1 that is later than tf1 cannot be detected. Therefore, the time t1 at which the ion with the maximum mass-to-charge ratio mb/z passes through the steady potential region 56 is limited as given by $$t1(mb/z)<tf1 \quad (4)$$

In order to cause all the ions lying in the mass range satisfying Eq. (4) to arrive at the extraction position 112 at the same time, the axial voltage V4(*t*) in the variable potential region 57 is made to satisfy the following Eq. (5):

$$V4(t) = V1-(V1-V3)\left(\frac{L2}{L1}\right)^2\left(\frac{t}{tf1-1}\right)^2 \quad (5)$$

where t is the time elapsed since the ions were expelled from the exit electrode 104.

Using the axial voltage V4(*t*) given by Eq. (5), the kinetic energy Ez assumed immediately before the ions are pushed out orthogonally at the extraction position 112 is given by $$Ez=ze(V1-V4(t)) \quad (6)$$

where the value of V4(*t*) depends on the mass-to-charge ratio (m/z) of the ions and so the energy Ez varies depending on different value of m/z. Therefore, an energy difference ΔEz given by Eq. (7) exists between the ions having ma/z and mb/z, respectively.

$$\Delta Ez=ze[V4(ta1)-V4(tb1)] \quad (7)$$

In the TOF mass analyzer 60, only ions which arrive at the extraction position 112 and which had an initial energy of Ez lying in a certain range can arrive at the detector 160. That is, some of the ions accelerated in the x-axis direction cannot reach the detector 160 unless the energy Ez falls within this certain range. The result is that ion loss occurs in the mass analyzer 60. To reduce the loss, the deflector 170 is mounted in the analyzer 60. In the deflector 170, the velocity in the z-axis direction is adjusted according to the mass-to-charge ratio (m/z) of the ions, thus improving the transmission factor up to the detector 160. Especially, all the ions having masses within the range can be guided to the detector 160 by adjusting the potential difference between the electrodes of the deflector 170 in such a way that the velocity vz1 in the z-axis direction assumed when the ions with m/z exit from the deflector 170 satisfies Eq. (8):

$$vz1 = \sqrt{\frac{2zeV5}{m}} \tag{8}$$

where zeV5 is the center value of the energy Ez of ion with valence value of z allowed in the TOF mass analyzer 60 and V5 is a transmission characteristic voltage intrinsic to the TOF mass analyzer. Eq. (8) indicates that the kinetic energy of the motion in the z-axis direction when the ions leave the deflector 170 is zeV5 irrespective of mass-to-charge ratio.

Setting the center axis potential on the deflector 170 and the potential in the equipotential region 61 equal to each other, the velocity vz1 in the z-axis direction (given by Eq. (8)) when the ion with m/z exits from the deflector 170 is given by $$vz1 = \sqrt{\frac{ze}{2mV6}} \cdot \frac{Lx}{Lz}\Delta\phi + v1 \tag{9}$$

where Lx is the length of the deflector 170 taken in the x-axis direction, Lz is the length of the deflector 170 taken in the z-axis direction, Δϕ is the potential difference between the electrodes 120 and 121, and V6 is the potential difference between the potential at the extraction position 112 and the potential at the center axis of the deflector 170 when the ions are pushed out. In Eq. (9), it is assumed that the potential difference Δϕ is constant while the ion with m/z is passing through the deflector 170.

The time tp in which the ions arrive at the deflector 170 since they were accelerated orthogonally at the extraction position 112 is given by $$tp = k\sqrt{\frac{m}{ze}} \tag{10}$$

where k is a constant determined by the potential distribution between the orthogonal acceleration region 180 and the deflector 170 and by the dimensions. The potential difference Δϕ is derived from Eqs. (8) and (9) and represented as a function of time tp, using Eq. (10). Thus, we have $$\Delta\phi(tp) = \frac{Lz}{Lx}\left[2\sqrt{V5 \cdot V6} - 2tp \cdot L2 \cdot \frac{\sqrt{V6 \cdot (V1 - V3)}}{tf1 \cdot k\sqrt{2(V1 - V3)} - L1 \cdot tp}\right] \tag{11}$$

If the potential difference between the electrodes 120 and 121 of the deflector 170 is varied with time as given by Eq. (11), the velocity in the z-axis direction is corrected and the transmission factor to the detector 170 is improved. If the potential in the equipotential region 61 is set to V7, voltages V8 and V9 applied to the electrodes 120 and 121, respectively, are given respectively by $$V8(tp) = V7 + \frac{1}{2}\Delta\phi(tp) \tag{12}$$

$$V9(tp) = V7 - \frac{1}{2}\Delta\phi(tp) \tag{13}$$

Figure 3:
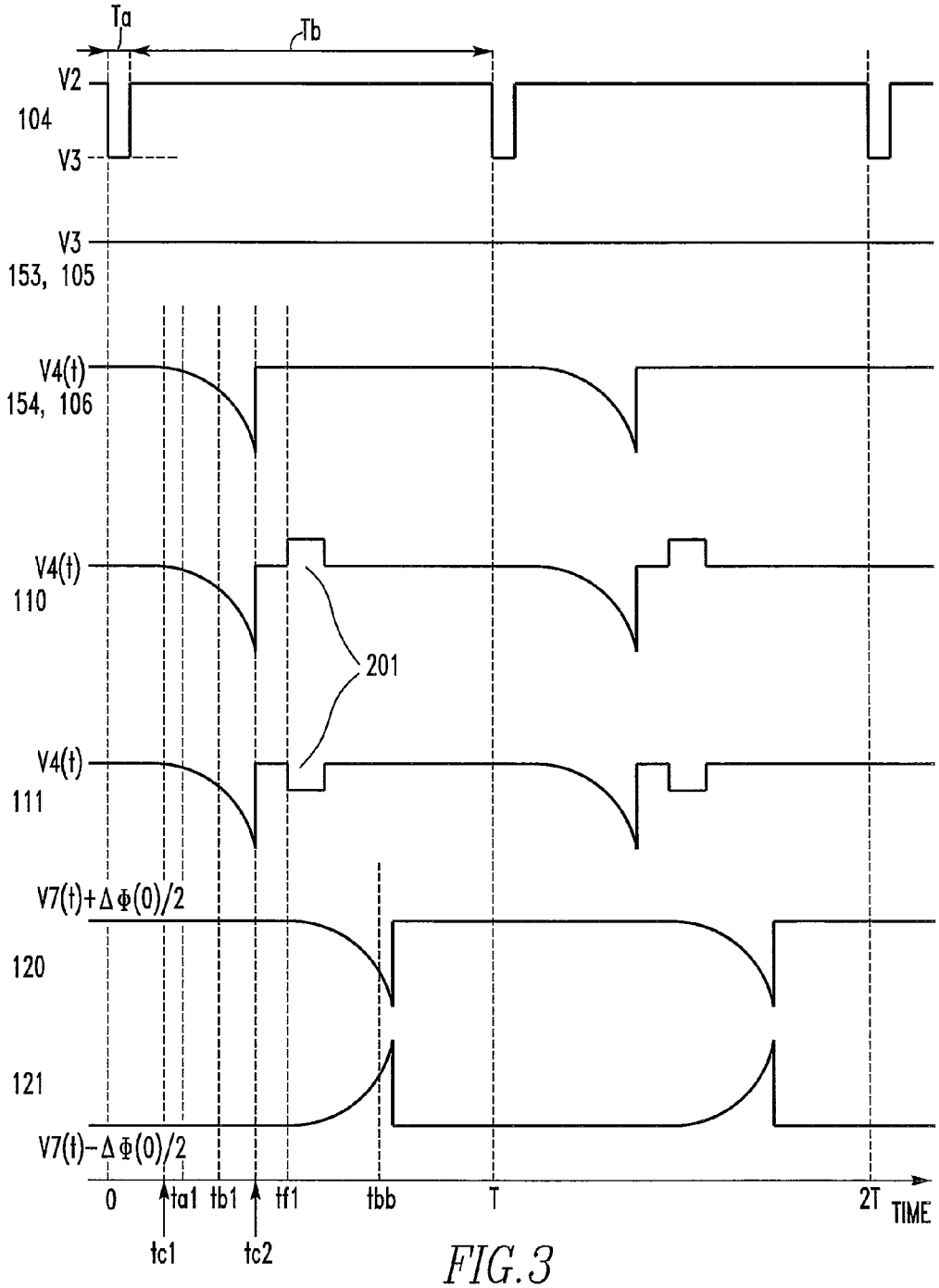
FIG. 3 is a diagram showing examples of voltages applied to various electrodes of the spectrometer of the first embodiment.

FIG. 3 is a diagram illustrating examples of voltages applied to the various electrodes of the TOF mass spectrometer 1A shown in FIG. 1. At instant 0, the voltage on the exit electrode 104 drops from V2 to V3. Pulsed ions are expelled from the collision cell 54 for time Ta. Then, the voltage on the exit electrode 104 increases to V2, and ions are stored for time Tb. The ion expelling period T is the sum of the opening time Ta and closing time Tb. The axial voltage in the multipole ion guide 153 and the voltage applied to the electrode 105 are always V3.

As described already in connection with FIG. 2, the lightest ions with ma/z among the ions in the set mass range first enter the multipole ion guide 154 at instant ta1. Subsequently, ions of successively increasing mass enter the guide 154. At instant tb1, the heaviest ions of mb/z enter the guide 154. The axial voltage in the guide 154 and the voltages on the electrode 106, pushout electrode 110, and extraction electrode 111 are varied according to Eq. (5) during a period between instant tc1 and instant tc2. The instant tc1 must precede the instant ta1. The instant tc2 must be later than the instant tb1. Notice that the pulsed ions have a time width comparable to the opening time Ta of the exit electrode 104 and so the instant tc1 is preferably earlier than the instant ta1 by a period of Ta or more. The instant tc2 is preferably later than the instant tb1 by a period of Ta or more.

Ions having masses lying in the set range all arrive at the extraction position 112 simultaneously at instant tf1. At the instant tf1, a pulsed voltage 201 is applied to make the pushout electrode 110 higher in potential than the extraction electrode 111 temporarily, thus pushing out the ions in the x-axis direction. In FIG. 3, the pulsed voltage 201 is applied to the two electrodes. The voltage 201 may be applied to only one of them.

The voltages on the electrodes 120 and 121 of the deflector 170 are varied with time according to Eqs. (12) and (13), respectively, after the instant tf1. This operation must be continued at least until the heaviest ion with mb/z passes through the deflector 170, i.e., the instant tbb. Then, the voltages on the electrodes 120 and 121 are returned to their initial values V7+½×Δϕ(0) and V7−½×Δϕ(0), respectively.

The period T of the expelling operation in the collision cell 54 must be longer than the time taken for the ion with m/z to reach the detector 160 since orthogonally accelerated at the extraction position 112.

As described so far, in the TOF mass spectrometer according to the first embodiment, lighter ones of the ions expelled in a pulsed manner from the collision cell (ion storage device or region) 54 travel at higher speeds in the steady potential region 56. In the variable potential region 57 and orthogonal acceleration region 180, the potential is set according to Eq. (5) so that heavier ions travel at higher speeds. All the ions having m/z lying in a preset mass range can be made to simultaneously arrive at or near the extraction position 112. Therefore, the TOF mass spectrometer according to the first embodiment makes it possible to orthogonally accelerate, without omission, all ions which have mass-to-charge ratios in the range and which arrive simultaneously at or near the extraction position 112 toward the detector 160.

Furthermore, in the TOF mass spectrometer according to the first embodiment, the deflector 170 composed of the two electrodes 120 and 121 parallel to the optical axis 141 (x-axis) of the TOF mass analyzer 60 is installed in the equipotential region 61. The kinetic energies of the ions moving along the optical axis 140 (z-axis) after passing through the deflector 170 can be kept constant regardless of mass-to-charge ratio by varying the potential difference between the electrodes 120 and 121 according to Eqs. (12) and (13) and according to mass-to-charge ratios of the ions passing through the deflector 170. Therefore, according to the TOF mass spectrometer of the first embodiment, even if the initial energy distribution of ions at the extraction position 112 is wide, almost all ions having m/z lying in the set range can be detected. Consequently, ion loss can be reduced further.

In this way, according to the first embodiment, ions having mass-to-charge ratios lying over the whole set range can be detected simply by applying a pulse 201 for orthogonal acceleration once if there is no ion loss when an ion stream is pulsed in the collision cell 54. As a consequence, a TOF mass spectrometer capable of achieving higher sensitivity and higher throughput than heretofore can be offered.

Additionally, according to the TOF mass spectrometer according to the first embodiment, the range of m/z of ions that can be detected is wide and, therefore, product ions having various mass-to-charge ratios can be detected at a time. The structure of precursor ions can be estimated efficiently.

2. Second Embodiment (1) Structure

Figure 4:
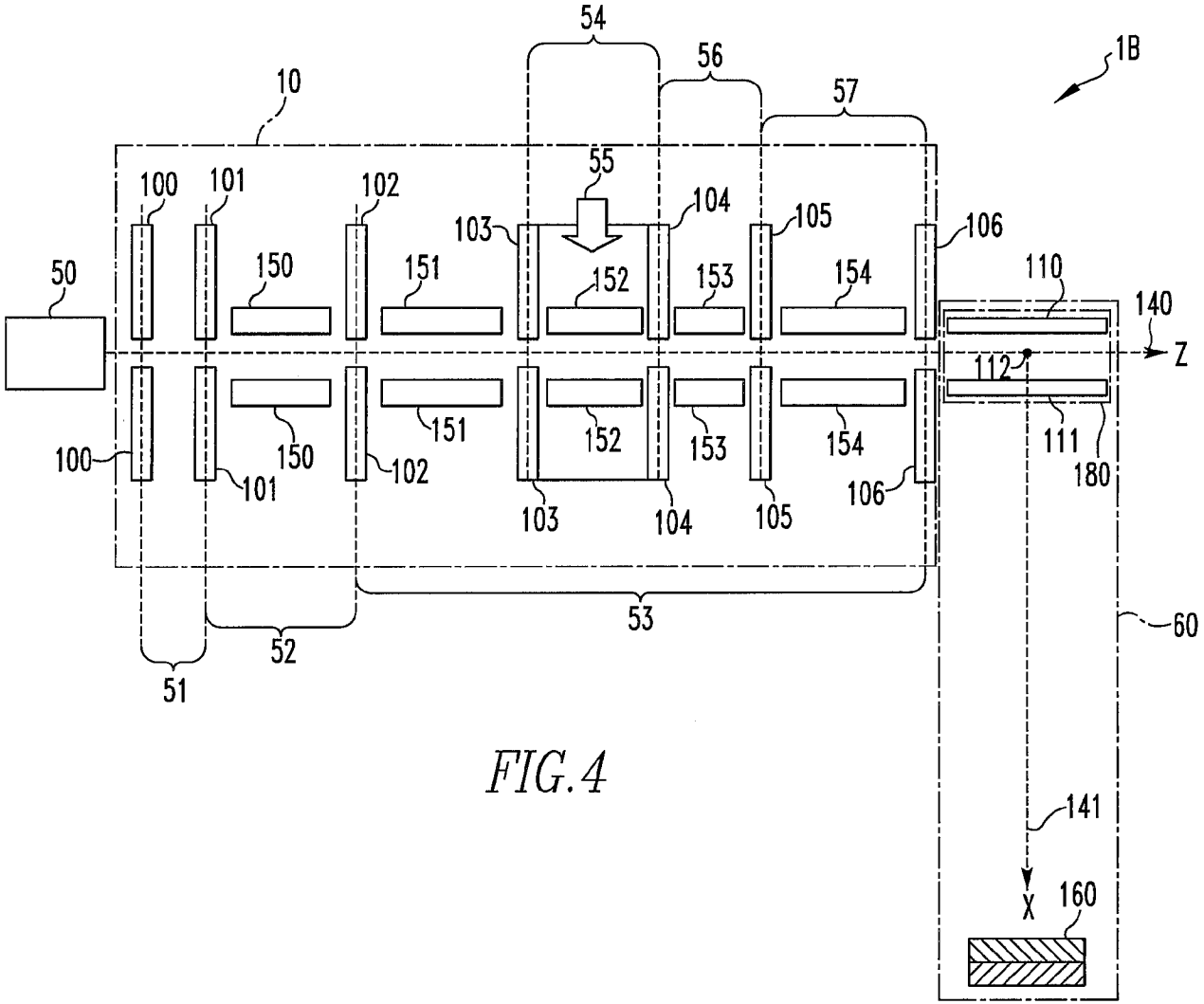
FIG. 4 is a schematic vertical cross section of a TOF mass spectrometer according to a second embodiment of the invention, showing the structure of the spectrometer.

FIG. 4 is a schematic vertical cross section of a time-of-flight (TOF) mass spectrometer according to a second embodiment of the invention, showing the structure of the spectrometer. In both FIGS. 1 and 4, like components are indicated by like reference numerals.

As shown in FIG. 4, the TOF mass spectrometer according to the second embodiment is generally indicated by reference numeral 1B and similar to the TOF mass spectrometer 1A according to the first embodiment except that the deflector 170 is omitted. Therefore, description of the structure of the spectrometer 1B is omitted. The difference of the spectrometer 1B with the spectrometer 1A is that the axial voltage in the multipole ion guide 153 and the voltages applied on the electrode 106, the pushout electrode 110 of the orthogonal acceleration region 180, and the extraction electrode 111 are different as described below.

(2) Operation

In the following description, it is assumed that the ions created by the ion source 50 are positive ions. The following theory can also be applied to an instrument in which the ions generated are negative ions if the voltage polarity is reversed.

In the TOF mass spectrometer 1A, the variable electrode V4(*t*) is applied to the electrode 106. On the other hand, in the spectrometer 1B, a steadily constant voltage V11 is applied to the electrode 106. Furthermore, in the spectrometer 1A, the voltages applied to the pushout electrode 110 and extraction electrode 111, respectively, are made coincident with the axial voltage in the multipole ion guide 154 from the instant when ions in the set mass range exit from the electrode 106 to the instant when they are accelerated orthogonally at or near the extraction electrode 112. In the spectrometer 1B, the steady voltage V11 is applied in the same way as to the electrode 106.

Figure 5:
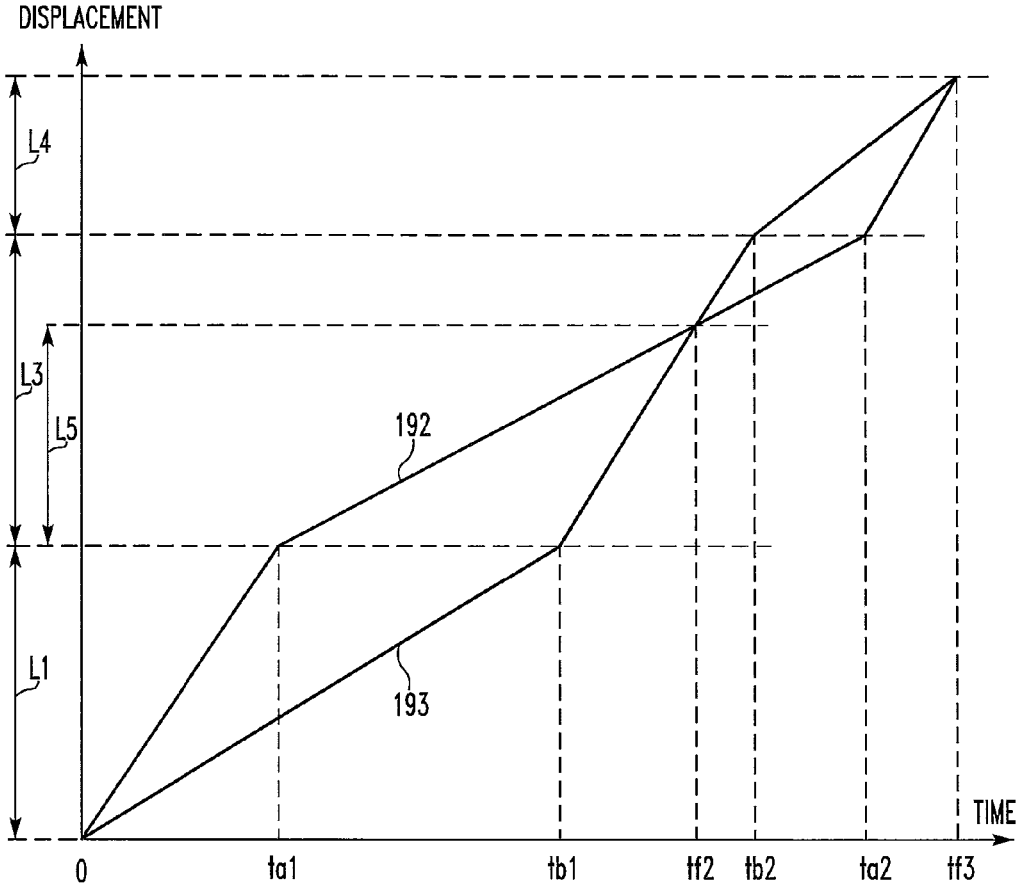
FIG. 5 is a graph showing examples of displacements of ions in the second embodiment.

FIG. 5 is a diagram showing examples of displacements of two ions having mass-to-charge ratios of ma/z and mb/z, respectively, (ma/z<mb/z), the displacements occurring during a period between the instant when they are expelled from the collision cell 54 and the instant when they reach the extraction position 112. In FIG. 5, the vertical axis indicates the displacement (distance) from the exit (exit electrode 104) of the collision cell 54. The horizontal axis indicates the time since the ions were expelled from the collision cell 54. The displacement of an ion with ma/z is indicated by 192. The displacement of an ion with mb/z is indicated by 193. L1 is the length of the steady potential region 56 (i.e., the distance from the exit electrode 104 to the electrode 105). L3 is the length of the variable potential region 57 (i.e., the distance from the electrode 105 to the electrode 106). L4 is the distance from the electrode 106 to the extraction position 112.

In the steady potential region 56, the ion with ma/z travels faster than the ion with mb/z. The ions having ma/z and mb/z, respectively, pass across the electrode 105 at instants ta1 and tb1, respectively. That is, the ions having ma/z and mb/z, respectively, arrive at the position of the distance of L1 at the instants ta1 and tb1, respectively.

In the variable potential region 57, the ion with mb/z travels faster than the ion with ma/z in a reverse manner. At instant tf2, the ion with mb/z overtakes the ion with ma/z. That is, assuming that the distance from the electrode 105 to this position is L5, the ion with ma/z and the ion mb/z simultaneously arrive at the position of the distance (L1+L5) at instant tf2.

Then, the successively lighter ions pass across the electrode 106 in turn. The ion with mb/z passes across the electrode 106 at instant tb2. The ion with ma/z passes across the electrode 106 at instant ta2. That is, the ions with ma/z and mb/z, respectively, arrive at the position of the distance (L1+L3) at instants ta2 and tb2, respectively.

In the orthogonal acceleration region 180, a steady voltage of V11 is applied to the pushout electrode 110 and the extraction electrode 111 during the period between the instant when ions in a given mass range (ma/z<m/z<mb/z) pass across the electrode 106 and the instant when they are accelerated orthogonally. Therefore, lighter ions again become faster than heavier ions. At instant tf3, the ion with ma/z catches up with the ion with mb/z at the extraction position 112. That is, the ions with ma/z and mb/z, respectively, arrive simultaneously at the position of the distance (L1+L3+L4) at the instant tf3.

For the sake of simplicity of discussion, it is assumed also in the present embodiment that the axial voltage in the electrode 105 and multipole ion guide 153 is set equal to the voltage V3 on the exit electrode 104 during opening unless otherwise specifically stated below.

In the present embodiment, the axial voltage in the multipole ion guide 154 is assumed to be a variable voltage V10(*t*) that varies with time. The axial voltage V10(*t*) is made different in characteristics between when ions enter the guide 154 and when they leave it. That is, let V10*i*(*t*) be the axial voltage in the ion guide 154 when ions enter. Let V10*e*(*t*) be the axial voltage in the guides 154 when ions leave. These voltages are set separately. The axial voltage V10*i*(*t*) is given by the following Eq. (14) by replacing L2 of Eq. (5) by L5 and tf1 by tf2.

$$V10i(tm1) = V1 - (V1 - V3)\left(\frac{L5}{L1}\right)^2\left(\frac{tm1}{tf2 - tm1}\right)^2 \tag{14}$$

where t1$m$ is the instant when an ion with m/z enters the multipole ion guide 154. The instant when tm1=0 is the time when the exit electrode 104 is opened. If the axial voltage in the ion guide 154 is varied with time according to Eq. (14) at least for a period beginning with the instant ta1 and ending with the tb1, heavier ions travel at higher speeds. At instant tf2, all ions in a mass range arrive at the point of distance (L1+L5) from the exit electrode 104. The velocity v2 of an ion within the ion guide 154 (i.e., in the variable potential region 57) is given by $$v2 = \sqrt{\frac{z}{m}}\sqrt{2e(V1 - V10i(tm1))} \tag{15}$$

On the other hand, the axial voltage V10$e$ (tm2) is so set that the total energy of ions about to exit from the multipole ion guide 154 is kept at a constant value zeV12 irrespective of mass-to-charge ratio, i.e., so as to satisfy the following Eq. (16).

$$\frac{1}{2}m(v2)^2 + zeV10e(tm2) = zeV12 \tag{16}$$

where tm2 is the instant when the ion with m/z exits from the ion guide 154. The instant when tm2=0 is the time when the exit electrode 104 is opened. The instants tm1 and tm2 are respectively given by the following Eqs. (17) and (18):

$$tm1 = L1\sqrt{\frac{m}{z}}\sqrt{\frac{1}{2e(V1 - V3)}} \tag{17}$$

$$tm2 = L3\sqrt{\frac{m}{z}}\sqrt{\frac{1}{2e[V1 - V10i(tm1)]}} + tm1 \tag{18}$$

Accordingly, it can be seen from Eqs. (14), (15), (17), and (18) that if the axial voltage V10$e$($tm$2) is set as given by Eq. (19), then the relationship of Eq. (16) holds.

$$V10e(tm2) = V12 - (V1 - V3)\left(\frac{L3 \cdot tf2 - L5 \cdot tm2}{L1 \cdot tm2 - L1 \cdot tf2}\right)^2 \tag{19}$$

Accordingly, if the axial voltage in the multipole ion guide 154 is set as given by Eq. (19) at least during a period between the instant tb2 and the instant ta2, the total energy of the ions is zeV12 when they leave the guide 154 regardless of mass-to-charge ratio. Consequently, the kinetic energy Ez of each ion in the orthogonal acceleration region 180 is as given by the following Eq. (20) and independent of mass-to-charge ratio:

$$Ez = ze(V12 - V11) \tag{20}$$

Accordingly, if the voltage V12 is set as given by the following Eq. (21), ion loss in the TOF mass analyzer 60 can be suppressed if the deflector 170 does not exist.

$$V12 = V5 + V11 \tag{21}$$

where V5 is the transmission characteristic voltage intrinsic to the TOF mass analyzer as already described in the first embodiment.

The time t4 taken for an ion with m/z to go from the electrode 106 to the extraction position 112 is given by $$t4 = L4\sqrt{\frac{m}{z}}\sqrt{\frac{1}{2e(V12 - V11)}} \tag{22}$$

Therefore, in order for all the ions in the mass range delineated by ma/z and mb/z to arrive at the extraction position 112 at the instant tf3, it is necessary to satisfy the following Eq. (23):

$$tm2(ma/z) + t4(ma/z) = tm2(mb/z) + t4(mb/z) = tf3 \tag{23}$$

In the present embodiment, the axial voltages V10$i$ and V10$e$ on the multipole ion guide 154 are set according to Eqs. (14) and (19), respectively, so that both Eqs. (16) and (23) hold.

Figure 6:
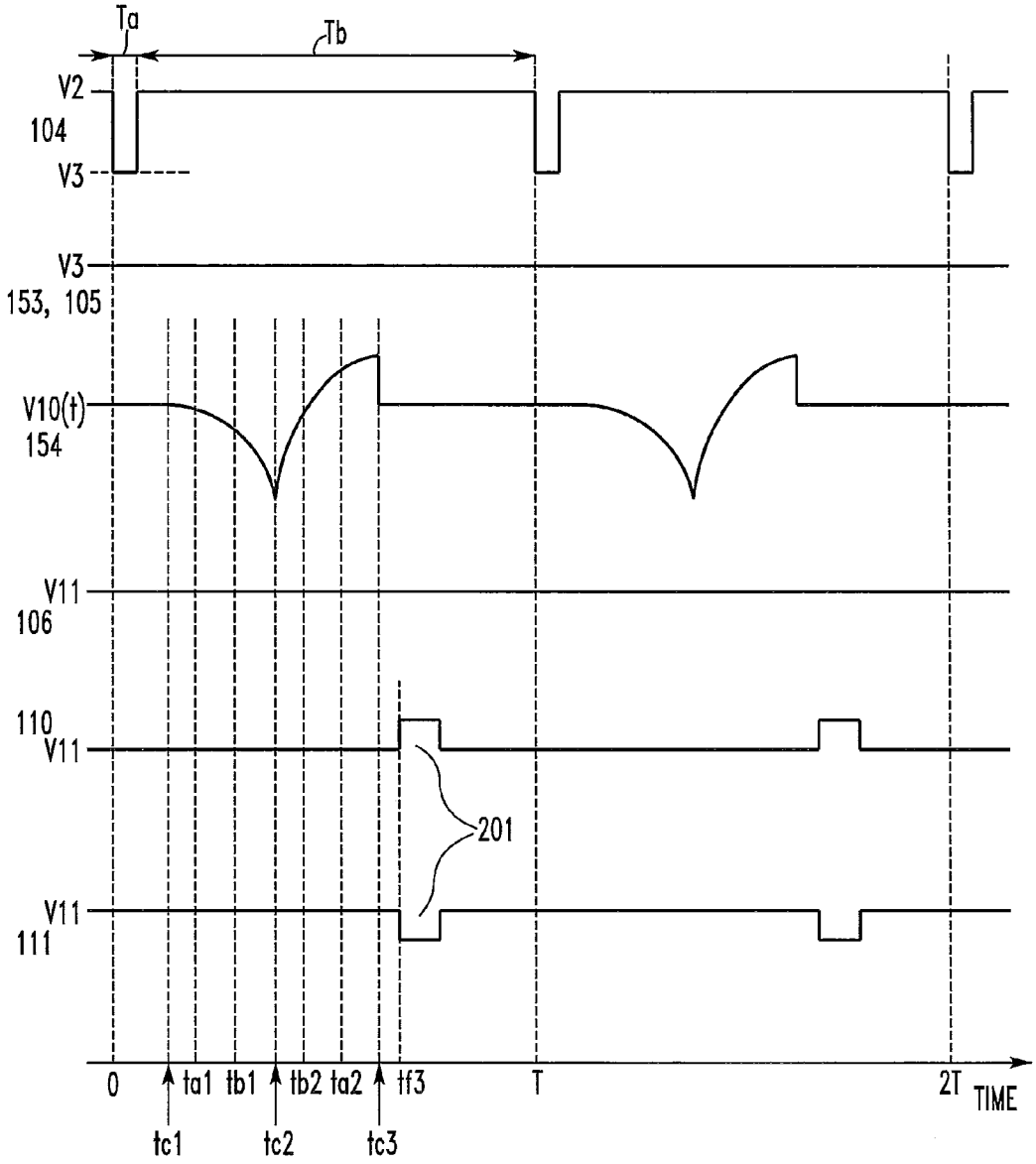
FIG. 6 is a diagram showing examples of voltages applied to the various electrodes of the spectrometer of the second embodiment.

FIG. 6 is a diagram showing examples of voltages applied to various electrodes of the TOF mass spectrometer 1B shown in FIG. 4. At instant t0, the voltage on the exit electrode 104 drops from V2 to V3. Pulsed ions are expelled from the collision cell 54 for a period of Ta. Then, the voltage on the exit electrode 104 increases to V2, and ions are stored for a period of Tb. The ion expelling period T is the sum of the opening time Ta and the closure time Tb. The axial voltage in the ion guide 153 and the voltage applied to the electrode 105 are always equal to the voltage V3.

As already described in connection with FIG. 5, the ion of ma/z which is lightest among ions in the set mass range first enters the multipole ion guide 154 at instant ta1. Then, ions of successively increasing mass enter the guide 154 in turn. At instant tb1, the heaviest ion with mb/z enters the guide 154. Conversely, the heaviest ion exits from the ion guide 154 first. At instant tb2, ion with mb/z exits from the guide 154. At instant ta2, ion with ma/z exits from the guide 154. In order to reverse the order in which ions exit from the variable potential region 57 from the order in which ions enter this potential region 57, the axial voltage in the ion guide 154 is varied according to Eq. (14) during the period from the instant tc1 to the instant tc2. The voltage is varied according to Eq. (19) during a period from the instant tc2 to the instant tc3. The instant tc1 must precede the instant ta1. The instant tc2 must be between the instants tb1 and tb2. The instant tc3 must be later than the instant ta2. Since pulsed ions have a time duration comparable to the opening time Ta of the exit electrode 104, it is desired that the instant tc1 be earlier than the instant t1$a$ at least by the period Ta and that the instant tc2 be later than the instant tb1 at least by the period Ta and earlier than the instant tb2 at least by the period Ta. Furthermore, it is desired that the instant tc3 be later than the instant ta2 at least by the period Ta.

Because the steady voltage V11 is applied to the electrode 106, pushout electrode 110, and extraction electrode 111, all the ions lying in the set mass range simultaneously arrive at the extraction position 112 at instant tf3. The kinetic energies of the ions moving in the z-axis direction are kept constant irrespective of mass-to-charge ratio. At the instant tf3, a pulsed voltage is applied so that the pushout electrode 110 temporarily becomes higher in potential than the extraction electrode 111, thus pushing out the ions in the x-axis direction. In FIG. 6, the pulsed voltage 201 is applied to the two electrodes. It is also possible to apply the voltage to only one of them.

The period T of the expelling operation in the collision cell 54 must be longer than the time taken for the ion with mb/z to arrive at the detector 160 since accelerated orthogonally at the extraction position 112.

As described so far, in the TOF mass spectrometer according to the second embodiment, with respect to ions expelled in a pulsed manner from the collision cell (ion storage device or region) 54, lighter ions travel at higher speeds in the steady potential region 56. In the variable potential region 57, heavier ions travel at higher speeds because the potential on incidence of ions is set according to Eq. (14). Heavier ions pass across the exit (electrode 106) in the variable potential region 57 earlier. In the orthogonal acceleration region 180, lighter ions are again made to travel at higher speeds because the potential is set constant. All the ions having mass-to-charge ratios lying in a preset range can be simultaneously brought to the extraction position 112 or its vicinity. Therefore, according to the TOF mass spectrometer of the second embodiment, all the ions having mass-to-charge ratios lying in this range and arriving at or near the extraction position 112 simultaneously can be accelerated orthogonally without omission and guided toward the detector 160.

Furthermore, in the TOF mass spectrometer according to the second embodiment, the kinetic energies of the ions moving along the optical axis 140 (z-axis) through the orthogonal acceleration region 180 can be kept constant irrespective of mass-to-charge ratio by setting the potential assumed when ions exit from the variable potential region 57 according to Eq. (19). Consequently, the TOF mass spectrometer of the second embodiment makes it possible to detect almost all ions having mass-to-charge ratios in the set range without mounting the deflector 170 as in the first embodiment. As a result, ion loss can be suppressed.

In this way, according to the second embodiment, if no ion loss takes place when an ion stream is pulsed in the collision cell 54, ions having mass-to-charge ratios over the whole set range can be detected by applying the pulse 201 for orthogonal acceleration only once. Hence, a TOF mass spectrometer capable of achieving higher sensitivity and higher throughput than heretofore can be offered.

Additionally, the TOF mass spectrometer according to the second embodiment can detect ions having a wide range of mass-to-charge ratios and so can detect product ions having various mass-to-charge ratios at a time. The structure of precursor ions can be estimated efficiently.

3. Third Embodiment (1) Structure

Figure 7:
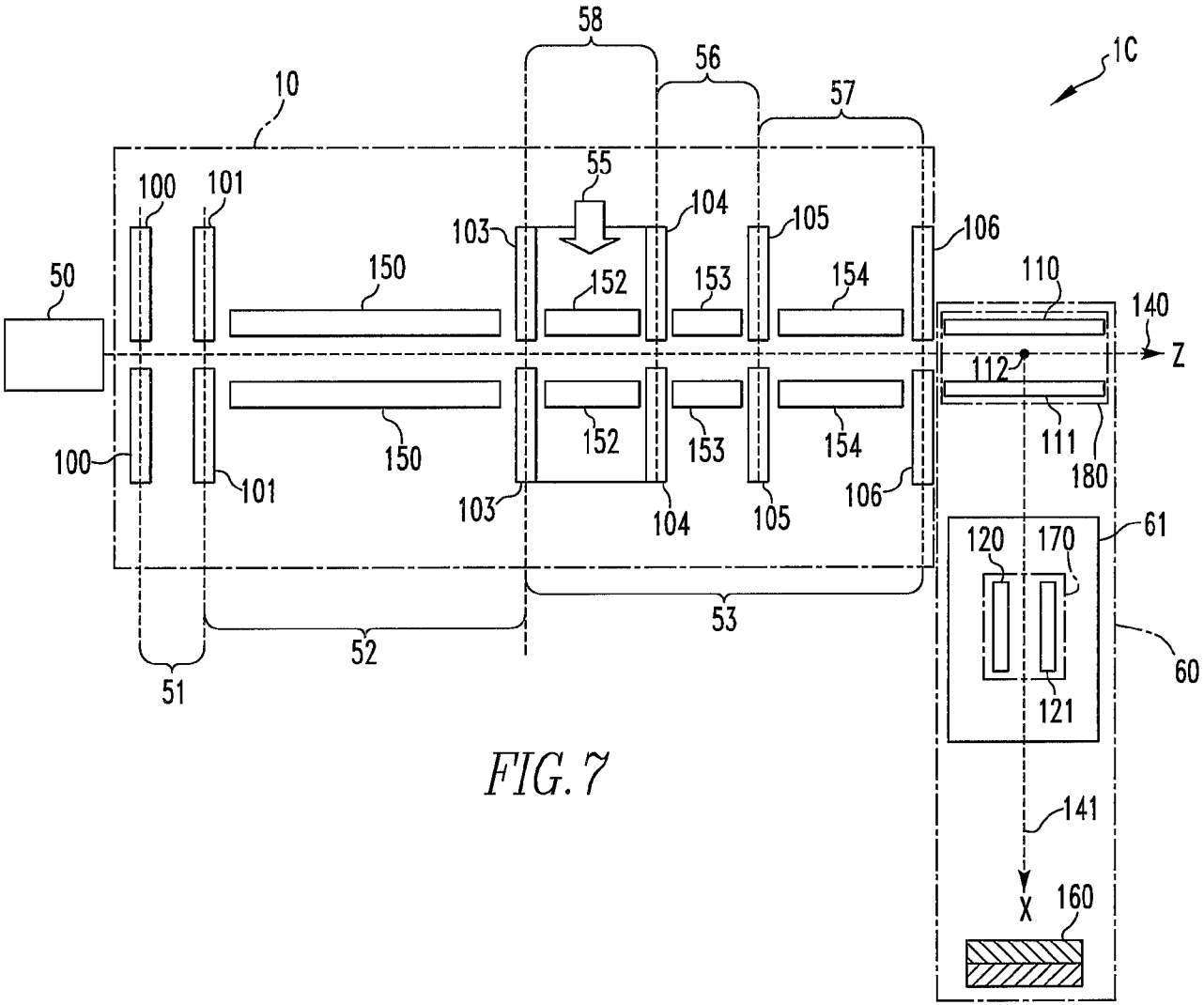
FIG. 7 is a schematic vertical cross section of a TOF mass spectrometer according to a third embodiment of the invention, showing the structure of the spectrometer.

FIG. 7 is a schematic vertical cross section of a time-of-flight (TOF) mass spectrometer according to a third embodiment of the invention, showing the structure of the spectrometer. In FIGS. 1 and 7, like components are indicated by like reference numerals.

As shown in FIG. 7, the TOF mass spectrometer according to the third embodiment is generally indicated by 1C and similar to the TOF mass spectrometer 1A according to the first embodiment except that the electrode 102 and quadrupole mass filter 151 are omitted and that the collision cell 54 has been replaced by an ion storage device or region 58.

The ion storage device 58 is identical in structure with the collision cell 54 of the TOF mass spectrometer 1A. The storage device 58 acts as the ion storage region of the present invention.

In this way, the TOF mass spectrometer 1C is built as an orthogonal acceleration TOF mass spectrometer (oa-TOFMS). The spectrometer 1C is similar to the spectrometer 1A in other respects and its description is omitted.

(2) Operation

Ions generated by the ion source 50 pass through the skimmer electrode 100, electrode 101, and multipole ion guide 150 and enter the ion storage device 58. The incident velocities of the ions are so adjusted that the ions are not fragmented in the ion storage device 58. In the storage device 58, storing and expelling of ions are repeated by applying a pulsed voltage to the exit electrode 104. Let V1 be the axial voltage in the multipole ion guide 152. During storing, the voltage V2 higher than the axial voltage V1 is applied to the exit electrode 104. During expelling, the voltage V3 lower than the axial voltage V1 is applied. The ions returning to the inlet electrode 103 after being bounced off the exit electrode 104 are reduced in energy because of the collisional cooling with the introduced gas. Consequently, almost no reverse flow of ions from the inlet electrode 103 takes place. The transmission factor of the ion storage device 58 can be maintained almost at 100%.

The structure of the spectrometer which is located behind the exit electrode 104 is identical in configuration and operation with the counterpart of the first embodiment. That is, in the TOF mass spectrometer 1C, too, Eqs. (1)-(13) can be applied intact. Consequently, the TOF mass spectrometer according to the third embodiment yields the same advantages as the first embodiment.

Similarly, an orthogonal acceleration TOF mass spectrometer (oa-TOFMS) can be built by removing the electrode 102 and quadrupole mass filter 151 from the TOF mass spectrometer 1B according to the second embodiment and replacing the collision cell 54 by the ion storage device 58. In this oa-TOFMS, too, Eqs. (14)-(23) can be applied intact. Consequently, this instrument yields the same advantages as the second embodiment.

It is to be noted that the present invention is not limited to the present embodiment. Rather, various changes and modifications are possible without departing from the gist and scope of the present invention.

For example, in the description of the first through third embodiments, the potential in the steady potential region 56 is equal to the voltage V3 on the exit electrode 104 during opening. It suffices that the potential in the steady potential region 56 be lower than the axial voltage V1 in the multipole ion guide 152. In this case, the steady potential region 56 forms an accelerating field but yet lighter ions travel at higher speeds. The voltage on the variable potential region 57 may be varied with time so as to cancel out the mass dispersion.

Furthermore, the description of the first through third embodiments is based on the premise that the collision cell 54 (ion storage device 58) is a two-dimensional ion trap in which the inlet electrode 103 and exit electrode 104 are disposed on the opposite sides of the multipole ion guide 152. The collision cell 54 (ion storage device 58) may also be a three-dimensional quadrupole ion trap in which end caps are disposed at the opposite sides of a ring electrode. In this case, the operation of the first through third embodiments is enabled by making the upstream end cap, downstream end cap, and center voltage on the 3D quadrupole ion trap correspond to the inlet electrode 103, exit electrode 104, and axial voltage in the multipole ion guide 152, respectively.

In the configuration of the second embodiment, the deflector 170 is omitted. The deflector 170 may also be mounted.

The present invention embraces structures substantially identical with the structures described in the embodiments (e.g., identical in function, method, and results or in purpose and advantages). Furthermore, the invention embraces structures which are similar to the structures described in the embodiments but in which nonessential parts have been replaced. In addition, the invention embraces structures which are identical in operation and advantages with the structures described in the embodiments or structures capable of achieving the same purpose. Further, the invention embraces the structures which have been described in the embodiments and to which known techniques are added.

Having thus described my invention with the detail and particularity required by the Patent Laws, what is desired protected by Letters Patent is set forth in the following claims.

The invention claimed is:

1. A time-of-flight mass spectrometer for performing mass analysis based on differences in flight time between ions which are different in mass-to-charge ratio, said spectrometer comprising:

a plurality of electrodes with controlled electrical potentials defining an ion transport region for causing ions created by an ion source to be transported in a first direction; and a time-of-flight mass analyzer for causing the ions transported via the ion storage region to be accelerated in a second direction at a given acceleration timing and guiding the ions into a detector;

wherein said ion transport region includes (a) an ion storage region defined by storage electrodes controlled for storing at least part of the ions created by the ion source and expelling the stored ions in the first direction, (b) a steady potential region defined by steady potential electrodes formed behind the ion storage region as viewed along the first direction and said steady potential electrodes controlled for providing a constant potential pathway when the ions expelled from the ion storage region pass through the steady potential region, said ions travelling in the steady potential region with mass dispersion and, (c) a single variable potential region defined by variable potential electrodes formed behind the steady potential region as viewed along the first direction and providing a potential pathway, said variable potential electrodes controlled to vary with elapsed time from the expulsion of ion pulses from the storage region when the ions passed through the steady potential region enter the variable potential region;

wherein in the said time-of-flight mass analyzer, ions accelerated in the second direction at or near a given extraction point can reach the detector; and wherein the variable potential electrodes in the variable potential region are controlled to vary with elapsed time from the expulsion of the lightest ion pulses from the storage region to the expulsion of the heaviest ions in such a way that the potential difference between the variable potential region and the steady potential region continuously increases and such that lighter ions that arrive first are decelerated and heavier ions that arrive later are accelerated so ions having different mass-to-charge ratios lying in a range to be observed simultaneously arrive at or near the extraction point at the given acceleration timing.

2. A time-of-flight mass spectrometer as set forth in claim 1, wherein the potential in said variable potential region is varied in such a way that ions having smaller mass-to-charge ratios among ions having mass-to-charge ratios in a range to be observed exit from the variable potential region earlier, and wherein the potential in the space through which ions travel until accelerated in the second direction after exiting from the variable potential region is varied to be equal to the potential in the variable potential region prior to said acceleration timing.

3. A time-of-flight mass spectrometer as set forth in claim 1, wherein said time-of-flight mass analyzer includes a deflector for temporally varying the magnitude of an electric field in said first direction according to the mass-to-charge ratio of each ion such that kinetic energies of ion passing through the deflector based on their movements in the first direction are kept constant.

4. A time-of-flight mass spectrometer as set forth in claim 3, wherein the axial voltage V(t) in said variable potential region when ions pass through it is given by $$V(t)=V1(V1-V3)\times(L2/L1)^2\times\{t/(tf1-t)\}^2$$

where V1 is the axial voltage in the ion storage region, V3 is the potential in the steady potential region when ions pass through it, L1 is the length of the steady potential region taken in the first direction, L2 is the distance between the entrance of the variable potential region and the extraction position, t is the time elapsed since ions were expelled from the ion storage region, and tf1 is the elapsed time from the expulsion of ion pulses and such that ions having different mass-to-charge ratios lying in a range to be observed simultaneously arrive at or near the extraction point.

5. A time-of-flight mass spectrometer as set forth in claim 1; wherein the potential in said variable potential region is so varied that ions having the mass-to-charge ratios lying in the range to be observed simultaneously arrive at or near the given position in the variable potential region and that ions having larger mass-to-charge ratios exit from the variable potential region earlier; and wherein the potential in the space through which ions travel until accelerated in the second direction after exiting from the variable potential region is kept constant at least until the given acceleration timing since the ions having a maximum mass-to-charge ratio within the range to be observed exited from the variable potential region.

6. A time-of-flight mass spectrometer as set forth in claim 5, wherein the potential in said variable potential region is varied according to the mass-to-charge ratios of the ions as they exit from the variable potential region such that kinetic energies of the ions which have mass-to-charge ratios within the range to be observed and are based on their motions in the first direction at the accelerating timing are kept constant.

7. A time-of-flight mass spectrometer as set forth in claim 6;

wherein the axial voltage V(t) in said variable potential region when ions enter it is given by $$V(t)=V1(V1-V3)\times(L5/L1)^2\times\{t/(tf2-t)\}^2$$

where V1 is the axial voltage in the ion storage region, V3 is the potential in the steady potential region when ions pass through it, L1 is the length of the steady potential region taken in the first direction, L3 is the length of the variable potential region taken in the first direction, t is the time elapsed since ions were expelled from the ion storage region, tf2 is the time for ions having mass-to-charge ratios in a range to be observed to arrive at the extraction position in the variable potential region since they exited from the ion storage region, L5 is the distance from the entrance of the variable potential region to the given position in the variable potential region, V11 is the potential in the space through which the ions travel until they are accelerated in the second direction after exiting from the variable potential region, and V5 is a transmission characteristic voltage intrinsic to the time-of-flight mass analyzer; and wherein the axial voltage V(t) in the variable potential region when the ions exit from the variable potential region is given by $$V(t)=V5+V11-(V1-V3)\times\{(L3\times tf2-L5\times t)/(L1\times t-L1\times tf2)\}^2.$$

8. A time-of-flight mass spectrometer as set forth in claim 1;

wherein said ion storage region includes an ion selection portion for selecting precursor ions having mass-to-charge ratios lying in a desired range from the ions created in the ion source and passing the selected ions, and wherein said ion storage region creates product ions by fragmenting at least parts of the precursor ions passed through the ion selection portion.

* * * * *

UNITED STATES PATENT AND TRADEMARK OFFICE

CERTIFICATE OF CORRECTION

PATENT NO. : 8,754,367 B2
APPLICATION NO. : 12/984674
DATED : June 17, 2014
INVENTOR(S) : Kou It is certified that error appears in the above-identified patent and that said Letters Patent is hereby corrected as shown below:

On the Title Page, item [75], delete "Toyko" and insert -- Tokyo --

In the Claims

Column 20, Line 5, Claim 4, delete "$V(t) = V1(V1-V3) \times (L2/L1)^2 \times \{t/(tf1-t)\}^2$" and insert -- $V(t) = V1-(V1-V3) \times (L2/L1)^2 \times \{t/(tf1-t)\}^2$ --

Column 20, Line 43, Claim 7, delete "$V(t) = V1(V1-V3) \times (L5/L1)^2 \times \{t/(tf2-t)\}^2$" and insert -- $V(t) = V1- (V1-V3) \times (L5/L1)^2 \times \{t/(tf2-t)\}^2$ --

Signed and Sealed this
Seventh Day of October, 2014

Michelle K. Lee

Michelle K. Lee
*Deputy Director of the United States Patent and Trademark Office*